US009378746B2

(12) United States Patent
Choo

(10) Patent No.: US 9,378,746 B2
(45) Date of Patent: Jun. 28, 2016

(54) METHOD AND APPARATUS FOR ENCODING AND DECODING HIGH FREQUENCY FOR BANDWIDTH EXTENSION

(71) Applicant: SAMSUNG ELECTRONICS CO., LTD., Suwon-si (KR)

(72) Inventor: Ki-hyun Choo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 231 days.

(21) Appl. No.: 13/848,177

(22) Filed: Mar. 21, 2013

(65) Prior Publication Data

US 2013/0290003 A1 Oct. 31, 2013

Related U.S. Application Data

(60) Provisional application No. 61/613,610, filed on Mar. 21, 2012, provisional application No. 61/719,799, filed on Oct. 29, 2012.

(51) Int. Cl.

| | |
|---|---|
| ***G10L 19/00*** | (2013.01) |
| ***G10L 19/20*** | (2013.01) |
| ***G10L 19/02*** | (2013.01) |
| ***G10L 21/038*** | (2013.01) |
| ***G10L 19/008*** | (2013.01) |
| *G10L 21/0388* | (2013.01) |

(52) U.S. Cl.

CPC ..... *G10L 19/008* (2013.01); *G10L 19/02* (2013.01); *G10L 19/20* (2013.01); *G10L 21/0388* (2013.01)

(58) Field of Classification Search

CPC ..... G10L 19/24; G10L 21/038; G10L 19/20; G10L 19/22; G10L 19/18; G10L 25/78; G10L 2025/783; G10L 2025/786; G10L 25/81; G10L 25/84; G10L 25/87; G10L 25/93; G10L 2025/932; G10L 2025/935; G10L 2025/937

See application file for complete search history.

(56) References Cited

U.S. PATENT DOCUMENTS

| | | | | |
|---|---|---|---|---|
| 5,414,796 | A * | 5/1995 | Jacobs et al. | 704/221 |
| 5,602,961 | A * | 2/1997 | Kolesnik et al. | 704/223 |
| 5,781,881 | A * | 7/1998 | Stegmann | 704/211 |
| 6,311,154 | B1 * | 10/2001 | Gersho et al. | 704/219 |
| 6,708,145 | B1 | 3/2004 | Liljeryd et al. | |
| 8,260,611 | B2 * | 9/2012 | Vos et al. | 704/223 |

(Continued)

FOREIGN PATENT DOCUMENTS

| | | |
|---|---|---|
| EP | 2 273 493 A1 | 1/2011 |
| KR | 10-0503415 B1 | 7/2005 |

(Continued)

OTHER PUBLICATIONS

Communication dated Jun. 26, 2013 issued by the International Searching Authority in counterpart International Patent Application No. PCT/KR2013/002372 (PCT/ISA/210 & 237).

(Continued)

*Primary Examiner* — Eric Yen

(74) *Attorney, Agent, or Firm* — Sughrue Mion, PLLC

(57) ABSTRACT

Disclosed are a method and apparatus for encoding and decoding a high frequency for bandwidth extension. The method includes: estimating a weight; and generating a high frequency excitation signal by applying the weight between random noise and a decoded low frequency spectrum.

4 Claims, 16 Drawing Sheets

(56) References Cited

U.S. PATENT DOCUMENTS

| | | | | |
|---|---|---|---|---|
| 2002/0055836 | A1* | 5/2002 | Nomura | 704/221 |
| 2002/0103637 | A1* | 8/2002 | Henn et al. | 704/206 |
| 2004/0111257 | A1 | 6/2004 | Sung et al. | |
| 2004/0267522 | A1* | 12/2004 | Allamanche et al. | 704/205 |
| 2005/0187761 | A1 | 8/2005 | Shi et al. | |
| 2007/0223577 | A1* | 9/2007 | Ehara et al. | 375/240.03 |
| 2007/0265837 | A1* | 11/2007 | Ehara | 704/201 |
| 2008/0027715 | A1* | 1/2008 | Rajendran et al. | 704/205 |
| 2008/0307945 | A1* | 12/2008 | Gatzsche et al. | 84/477 R |
| 2009/0198501 | A1 | 8/2009 | Jeong et al. | |
| 2009/0222261 | A1* | 9/2009 | Jung et al. | 704/219 |
| 2009/0292537 | A1* | 11/2009 | Ehara et al. | 704/230 |
| 2010/0070284 | A1 | 3/2010 | Oh et al. | |
| 2011/0035213 | A1* | 2/2011 | Malenovsky et al. | 704/208 |
| 2011/0194598 | A1 | 8/2011 | Miao et al. | |
| 2013/0019738 | A1* | 1/2013 | Haupt et al. | 84/622 |
| 2013/0166287 | A1* | 6/2013 | Gao | 704/207 |

FOREIGN PATENT DOCUMENTS

| | | | |
|---|---|---|---|
| KR | 10-0571831 | B1 | 4/2006 |
| KR | 10-2009-0083070 | A | 8/2009 |
| KR | 10-2010-0134576 | A | 12/2010 |
| WO | 2008060068 | A1 | 5/2008 |
| WO | 2010/066158 | A1 | 6/2010 |

OTHER PUBLICATIONS

Communication dated Sep. 14, 2015 issued by the European Patent Office in counterpart European Patent Application No. 13763979.5.

* cited by examiner

METHOD AND APPARATUS FOR ENCODING AND DECODING HIGH FREQUENCY FOR BANDWIDTH EXTENSION

CROSS-REFERENCE TO RELATED PATENT APPLICATION

This application claims priority from U.S. Provisional Application No. 61/613,610, filed on Mar. 21, 2012, and from U.S. Provisional Application No. 61/719,799, filed on Oct. 29, 2012, in the US Patent Office, the disclosures of which are incorporated herein in their entirety by reference.

BACKGROUND

1. Field

Exemplary embodiments relate to audio encoding and decoding, and more particularly, to a method and apparatus for encoding and decoding a high frequency for bandwidth extension.

2. Description of the Related Art

The coding scheme in G.719 is developed and standardized for the purpose of teleconferencing and performs a frequency domain transform by performing a modified discrete cosine transform (MDCT) to directly code an MDCT spectrum for a stationary frame and change a time domain aliasing order for a non-stationary frame so as to consider temporal characteristics. A spectrum obtained for a non-stationary frame may be constructed in a similar form to a stationary frame by performing interleaving to construct a codec with the same framework as the stationary frame. Energy of the constructed spectrum is obtained, normalized, and quantized. In general, energy is represented as a root mean square (RMS) value, and from a normalized spectrum, the number of bits required for each band is calculated through energy-based bit allocation, and a bitstream is generated through quantization and lossless coding based on information regarding the bit allocation for each band.

According to the decoding scheme in G.719, as a reverse process of the coding scheme, a normalized dequantized spectrum is generated by dequantizing energy from a bitstream, generating bit allocation information based on the dequantized energy, and dequantizing a spectrum. When bits are insufficient, a dequantized spectrum may not exist in a specific band. To generate noise for the specific band, a noise filling method for generating noise according to a transmitted noise level by generating a noise codebook based on a dequantized spectrum of a low frequency is applied. For a band of a specific frequency or higher, a bandwidth extension scheme for generating a high frequency signal by folding a low frequency signal is applied.

SUMMARY

Exemplary Embodiments provide a method and apparatus for encoding and decoding a high frequency for bandwidth extension, by which the quality of a reconstructed signal may be improved and a multimedia device employing the same.

According to an aspect of an exemplary embodiment, there is provided a method of encoding a high frequency for bandwidth extension, the method including: generating excitation type information for each band, for estimating a weight which is applied to generate a high frequency excitation signal at a decoding end; and generating a bitstream including the excitation type information for each band.

According to an aspect of an exemplary embodiment, there is provided a method of decoding a high frequency for bandwidth extension, the method including: estimating a weight; and generating a high frequency excitation signal by applying the weight between random noise and a decoded low frequency spectrum.

BRIEF DESCRIPTION OF THE DRAWINGS

The above and other features and advantages will become more apparent by describing in detail exemplary embodiments thereof with reference to the attached drawings in which.

DETAILED DESCRIPTION

Figure 1:
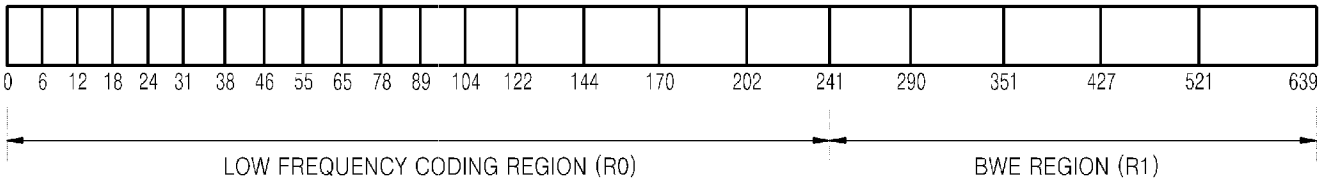
FIG. 1 illustrates bands for a low frequency signal and bands for a high frequency signal that are constructed, according to an exemplary embodiment.

The present inventive concept may allow various kinds of change or modification and various changes in form, and specific exemplary embodiments will be illustrated in drawings and described in detail in the specification. However, it should be understood that the specific exemplary embodiments do not limit the present inventive concept to a specific disclosing form but include every modified, equivalent, or replaced one within the spirit and technical scope of the present inventive concept. In the following description, well-known functions or constructions are not described in detail since they would obscure the invention with unnecessary detail.

Although terms, such as 'first' and 'second', can be used to describe various elements, the elements cannot be limited by the terms. The terms can be used to classify a certain element from another element.

The terminology used in the application is used only to describe specific exemplary embodiments and does not have any intention to limit the present inventive concept. Although general terms as currently widely used as possible are selected as the terms used in the present inventive concept while taking functions in the present inventive concept into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the invention. Accordingly, the terms used in the present inventive concept should be defined not by simple names of the terms but by the meaning of the terms and the content over the present inventive concept.

An expression in the singular includes an expression in the plural unless they are clearly different from each other in a context. In the application, it should be understood that terms, such as 'include' and 'have', are used to indicate the existence of implemented feature, number, step, operation, element, part, or a combination of them without excluding in advance the possibility of existence or addition of one or more other features, numbers, steps, operations, elements, parts, or combinations of them.

Exemplary embodiments of the present invention will now be described in detail with reference to the accompanying drawings. Like reference numerals in the drawings denote like elements, and thus their repetitive description will be omitted.

FIG. 1 illustrates bands for a low frequency signal and bands for a high frequency signal that are constructed, according to an exemplary embodiment. According to an exemplary embodiment, a sampling rate is 32 KHz, and 640 discrete cosine transform (MDCT) spectral coefficients may be formed by 22 bands; in detail, 17 bands for the low frequency signal and 5 bands for the high frequency signal. A start frequency of the high frequency signal is a $241^{st}$ spectral coefficient, and $0^{th}$ to $240^{th}$ spectral coefficients may be defined as R0 as a region to be coded in a low frequency coding scheme. In addition, $241^{st}$ to $639^{th}$ spectral coefficients may be defined as R1 as a region for which bandwidth extension (BWE) is performed. In the region R1, a band to be coded in a low frequency coding scheme may also exist.

Figure 2A:
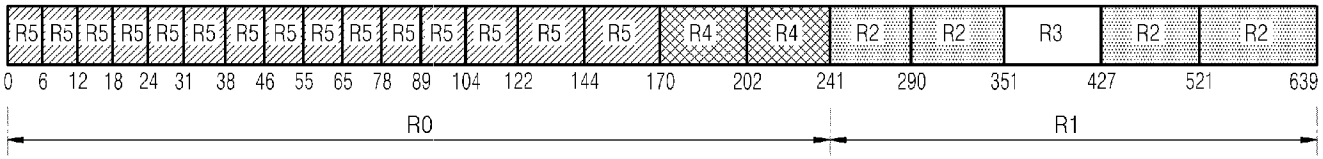
FIGS. 2A to 2C illustrate classification of a region R0 and a region R1 into R4 and R5, and R2 and R3, respectively, in correspondence with selected coding schemes, according to an exemplary embodiment.
Figure 2B:
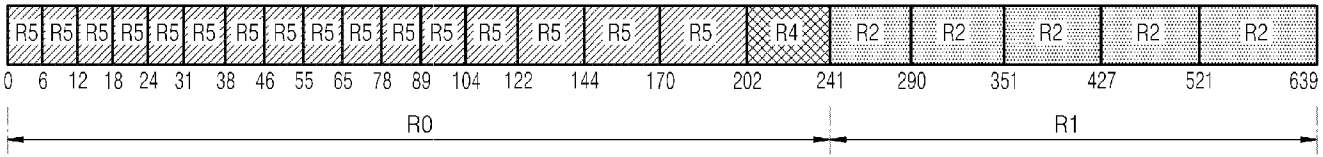
Figure 2C:
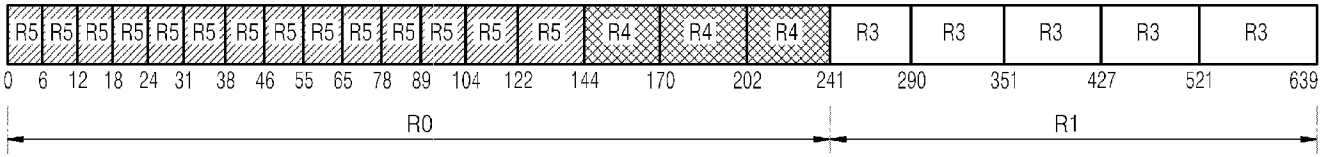

FIGS. 2A to 2C illustrate classification of the region R0 and the region R1 into R4 and R5, and R2 and R3, respectively, in correspondence with selected coding schemes, according to an exemplary embodiment. The region R1 that is a BWE region may be classified into R2 and R3, and the region R0 that is a low frequency coding region may be classified into R4 and R5. R2 indicates a band containing a signal to be quantized and lossless-coded in a low frequency coding scheme, e.g., a frequency domain coding scheme, and R3 indicates a band in which there are no signals to be coded in a low frequency coding scheme. However, even though R2 is defined so as to allocate bits for coding in a low frequency coding scheme, a band R2 may be generated in the same way as a band R3 due to the lack of bits. R5 indicates a band for which coding is performed in a low frequency coding scheme with allocated bits, and R4 indicates a band for which coding cannot be performed even for a low frequency signal due to no marginal bits or noise should be added due to less allocated bits. Thus, R4 and R5 may be identified by determining whether noise is added, wherein the determination may be performed by a percentage of the number of spectrums in a low-frequency-coded band, or may be performed based on in-band pulse allocation information when factorial pulse coding (FPC) is used. Since bands R4 and R5 can be identified when noise is added thereto in a decoding process, the bands R4 and R5 may not be clearly identified in an encoding process. Bands R2 to R5 may have mutually different information to be encoded, and different decoding schemes may also be applied to the bands R2 to R5.

In the illustration shown in FIG. 2A, two bands containing $170^{th}$ to $240^{th}$ spectral coefficients in the low frequency coding region R0 are R4 to which noise is added, and two bands containing $241^{st}$ to $350^{th}$ spectral coefficients and two bands containing $427^{th}$ to $639^{th}$ spectral coefficients in the BWE region R1 are R2 to be coded in a low frequency coding scheme. In the illustration shown in FIG. 2B, one band containing $202^{nd}$ to $240^{th}$ spectral coefficients in the low frequency coding region R0 is R4 to which noise is added, and all the five bands containing $241^{st}$ to $639^{th}$ spectral coefficients in the BWE region R1 are R2 to be coded in a low frequency coding scheme. In the illustration shown in FIG. 2C, three bands containing $144^{th}$ to $240^{th}$ spectral coefficients in the low frequency coding region R0 are R4 to which noise is added, and R2 does not exist in the BWE region R1. In general, R4 in the low frequency coding region R0 may be distributed in a high frequency band, and R2 in the BWE region R1 may not be limited to a specific frequency band.

Figure 3:
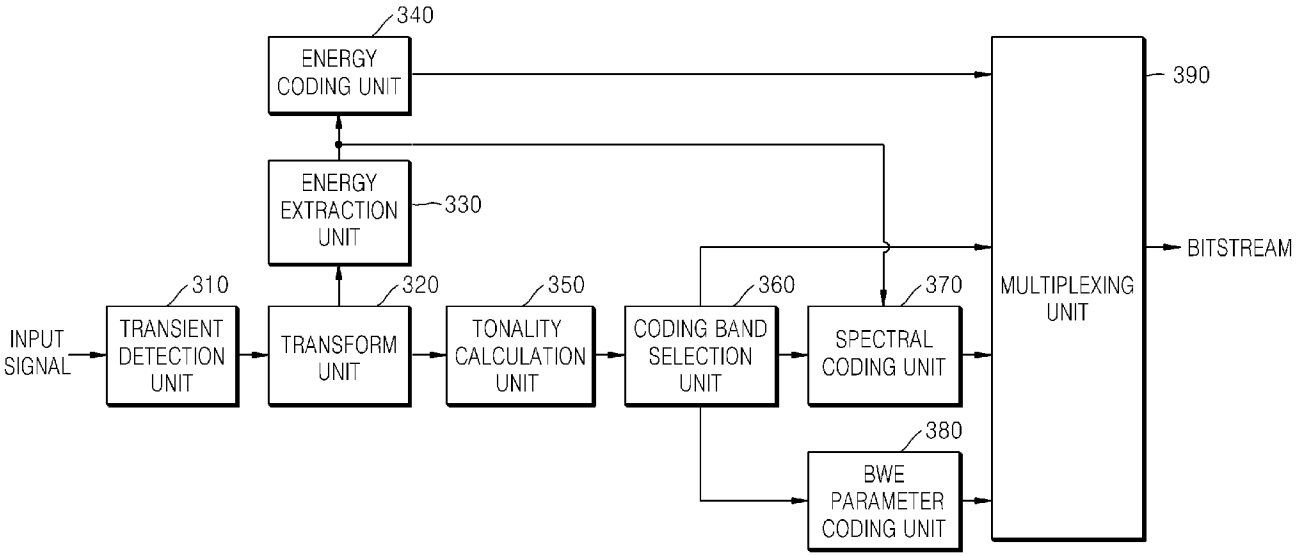
FIG. 3 is a block diagram of an audio encoding apparatus according to an exemplary embodiment.

FIG. 3 is a block diagram of an audio encoding apparatus according to an exemplary embodiment.

The audio encoding apparatus shown in FIG. 3 may include a transient detection unit 310, a transform unit 320, an energy extraction unit 330, an energy coding unit 340, a tonality calculation unit 350, a coding band selection unit 360, a spectral coding unit 370, a BWE parameter coding unit 380, and a multiplexing unit 390. The components may be integrated in at least one module and implemented by at least one processor (not shown). In FIG. 3, an input signal may indicate music, speech, or a mixed signal of music and speech and may be largely divided into a speech signal and another general signal. Hereinafter, the input signal is referred to as an audio signal for convenience of description.

Referring to FIG. 3, the transient detection unit 310 may detect whether a transient signal or an attack signal exists in an audio signal in a time domain. To this end, various well-known methods may be applied, for example, an energy change in the audio signal in the time domain may be used. If a transient signal or an attack signal is detected from a current frame, the current frame may be defined as a transient frame, and if a transient signal or an attack signal is not detected from a current frame, the current frame may be defined as a non-transient frame, e.g., a stationary frame.

The transform unit 320 may transform the audio signal in the time domain to a spectrum in a frequency domain based on a result of the detection by the transient detection unit 310. MDCT may be applied as an example of a transform scheme, but the exemplary embodiment is not limited thereto. In addition, a transform process and an interleaving process for a transient frame and a stationary frame may be performed in the same way as in G.719, but the exemplary embodiment is not limited thereto.

The energy extraction unit 330 may extract energy of the spectrum in the frequency domain, which is provided from the transform unit 320. The spectrum in the frequency domain may be formed in band units, and lengths of bands may be uniform or non-uniform. Energy may indicate average energy, average power, envelope, or norm of each band. The energy extracted for each band may be provided to the energy coding unit 340 and the spectral coding unit 370.

The energy coding unit 340 may quantize and lossless-code the energy of each band that is provided from the energy extraction unit 330. The energy quantization may be performed using various schemes, such as a uniform scalar quantizer, a non-uniform scalar quantizer, a vector quantizer, and the like. The energy lossless coding may be performed using various schemes, such as arithmetic coding, Huffman coding, and the like.

The tonality calculation unit 350 may calculate a tonality for the spectrum in the frequency domain that is provided from the transform unit 320. By calculating a tonality of each band, it may be determined whether a current band has a tone-like characteristic or a noise-like characteristic. The tonality may be calculated based on a spectral flatness measurement (SFM) or may be defined by a ratio of a peak to a mean amplitude as in Equation 1.

$$T(b) = \frac{\max[S(k) * S(k)]}{\frac{1}{N}\sum S(k) * S(k)} \quad (1)$$

In Equation 1, T(b) denotes a tonality of a band b, N denotes a length of the band b, and S(k) denotes a spectral coefficient in the band b. T(b) may be used by being changed to a dB value.

The tonality may be calculated by a weighted sum of a tonality of a corresponding band in a previous frame and a tonality of a corresponding band in a current frame. In this case, the tonality T(b) of the band b may be defined by Equation 2.

$$T(b)=a0*T(b,n-1)+(1-a0)*T(b,n) \quad (2)$$

In Equation 2, T(b,n) denotes a tonality of the band b in a frame n, and a0 denotes a weight and may be set to an optimal value in advance through experiments or simulations.

Tonalities may be calculated for bands constituting a high frequency signal, for example, the bands in the region R1 in FIG. 1. However, according to circumstances, tonalities may also be calculated for bands constituting a low frequency signal, for example, the bands in the region R0 in FIG. 1. When a spectral length in a band is too long, since an error may occur in the calculation of tonality, tonalities may be calculated by segmenting the band, and a mean value or a maximum value of the calculated tonalities may be set as a tonality representing the band.

The coding band selection unit 360 may select a coding band based on the tonality of each band. According to an exemplary embodiment, R2 and R3 may be determined for the BWE region R1 in FIG. 1. In addition, R4 and R5 in the low frequency coding region R0 in FIG. 1 may be determined by considering allowable bits.

In detail, a process of selecting a coding band in the low frequency coding region R0 will now be described.

R5 may be coded by allocating bits thereto in a frequency domain coding scheme. According to an exemplary embodiment, for coding in a frequency domain coding scheme, an FPC scheme, in which pulses are coded based on bits allocated according to bit allocation information regarding each band, may be applied. Energy may be used for the bit allocation information, and a large number of bits may be designed to be allocated to a band having high energy while a small number of bits are allocated to a band having low energy. The allowable bits may be limited according to a target bit rate, and since bits are allocated under a limited condition, when the target bit rate is low, band discrimination between R4 and R5 may be more meaningful. However, for a transient frame, bits may be allocated in a method other than that for a stationary frame. According to an exemplary embodiment, for a transient frame, bits may be set not to be forcibly allocated to the bands of the high frequency signal. That is, sound quality may be improved at a low target bit rate by allocating no bits to bands after a specific frequency in a transient frame to express the low frequency signal well. No bits may be allocated to bands after the specific frequency in a stationary frame. In addition, bits may be allocated to bands having energy exceeding a predetermined threshold from among the bands of the high frequency signal in the stationary frame. The bit allocation is performed based on energy and frequency information, and since the same scheme is applied in an encoding unit and a decoding unit, additional information does not have to be included in a bitstream. According to an exemplary embodiment, the bit allocation may be performed by using energy that is quantized and then dequantized.

Figure 4:
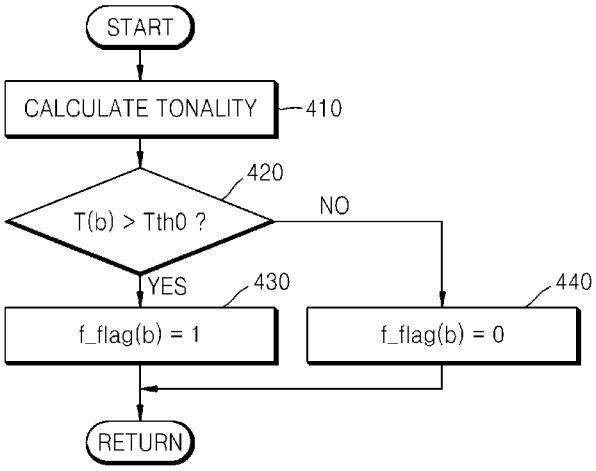
FIG. 4 is a flowchart illustrating a method of determining R2 and R3 in a BWE region R1, according to an exemplary embodiment.

FIG. 4 is a flowchart illustrating a method of determining R2 and R3 in the BWE region R1, according to an exemplary embodiment. In the method described with reference to FIG. 4, R2 indicates a band containing a signal coded in a frequency domain coding scheme, and R3 indicates a band containing no signal coded in a frequency domain coding scheme. When all bands corresponding to R2 are selected in the BWE region R1, the residual bands correspond to R3. Since R2 indicates a band having the tone-like characteristic, R2 has a tonality of a large value. On the contrary, R2 has noiseness of a small value, other than the tonality.

Referring to FIG. 4, a tonality T(b) is calculated for each band b in operation 410, and the calculated tonality T(b) is compared with a predetermined threshold Tth0 in operation 420.

In operation 430, the band b of which the calculated tonality T(b) is greater than the predetermined threshold Tth0 as a result of the comparison in operation 420 is allocated as R2, and f_flag(b) is set to 1.

In operation 440, the band b of which the calculated tonality T(b) is not greater than the predetermined threshold Tth0 as a result of the comparison in operation 420 is allocated as R3, and f_flag(b) is set to 0.

f_flag(b) that is set for each band b contained in the BWE region R1 may be defined as coding band selection information and included in a bitstream. The coding band selection information may not be included in the bitstream.

Referring back to FIG. 3, the spectral coding unit 370 may perform frequency domain coding on spectral coefficients for the bands of the low frequency signal and bands R2 of which f_flag(b) is set to 1 based on the coding band selection information generated by the coding band selection unit 360. The frequency domain coding may include quantization and lossless coding, and according to an exemplary embodiment, an FPC scheme may be used. The FPC scheme represents location, magnitude, and sign information of coded spectral coefficients as pulses.

The spectral coding unit 370 may generate bit allocation information based on the energy for each band that is provided from the energy extraction unit 330, calculate the number of pulses for FPC based on bits allocated to each band, and code the number of pulses. At this time, when some bands of the low frequency signal are not coded or are coded with a too-small number of bits due to the lack of bits, bands to which noise needs to be added at a decoding end may exist. These bands of the low frequency signal may be defined as R4. For bands for which coding is performed with a sufficient number of bits, noise does not have to be added at the decoding end, and these bands of the low frequency signal may be defined as R5. Since discrimination between R4 and R5 for the low frequency signal at an encoding end is meaningless, separate coding band selection information does not have to be generated. The number of pulses may be merely calculated based on bits allocated to each band form among all the bits and may be coded.

The BWE parameter coding unit 380 may generate BWE parameters required for high frequency bandwidth extension by including information If_att_flag indicating that bands R4 among the bands of the low frequency signal are bands to which noise needs to be added. The BWE parameters required for high frequency bandwidth extension may be generated at the decoding end by appropriately weighting the low frequency signal and random noise. According to another exemplary embodiment, the BWE parameters required for high frequency bandwidth extension may be generated by appropriately weighting a signal, which is obtained by whitening the low frequency signal, and random noise.

The BWE parameters may include information all_noise indicating that random noise should be added more for generation of the entire high frequency signal of a current frame and information all_If indicating that the low frequency signal should be emphasized more. The information If_att_flag, the information all_noise, and the information all_If may be transmitted once for each frame, and one bit may be allocated to each of the information tatt_flag, the information all_noise, and the information all_If and transmitted. According to circumstances, the information tatt_flag, the information all_noise, and the information all_If may be separated and transmitted for each band.

Figure 5:
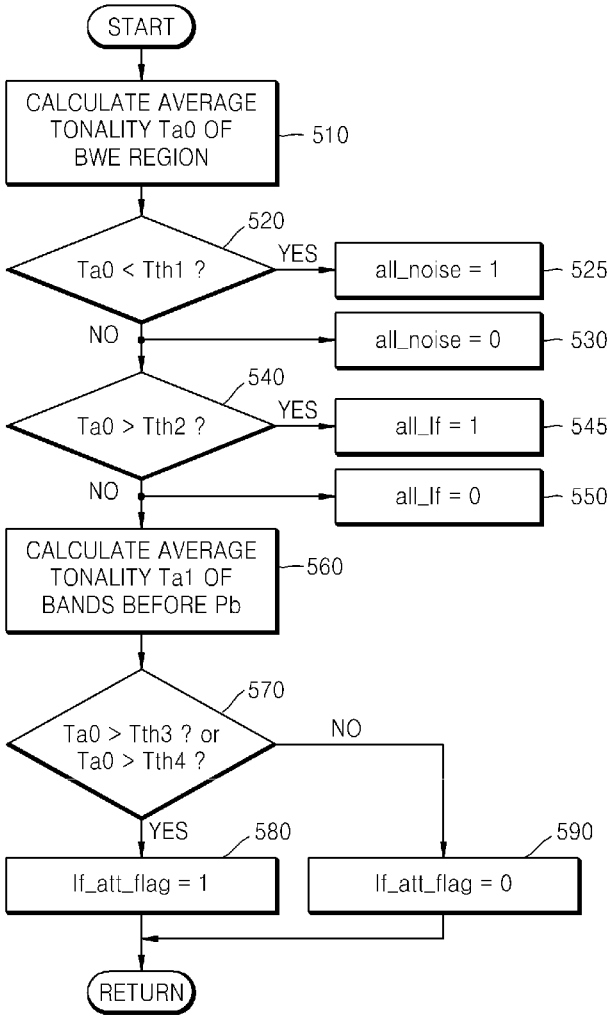
FIG. 5 is a flowchart illustrating a method of determining BWE parameters, according to an exemplary embodiment.

FIG. 5 is a flowchart illustrating a method of determining BWE parameters, according to an exemplary embodiment. In FIG. 5, the band containing $241^{st}$ to $290^{th}$ spectral coefficients and the band containing $521^{st}$ to $639^{th}$ spectral coefficients in the illustration of FIG. 2, i.e., the first band and the last band in the BWE region R1, may be defined as Pb and Eb, respectively.

Referring to FIG. 5, an average tonality Ta0 in the BWE region R1 is calculated in operation 510, and the average tonality Ta0 is compared with a threshold Tth1 in operation 520.

In operation 525, if the average tonality Ta0 is less than the threshold Tth1 as a result of the comparison in operation 520, all_noise is set to 1, and both all_If and If_att_flag are set to 0 and are not transmitted.

In operation 530, if the average tonality Ta0 is greater than or equal to the threshold Tth1 as a result of the comparison in operation 520, all_noise is set to 0, and all_If and tatt_flag are set as described below and transmitted.

In operation 540, the average tonality Ta0 is compared with a threshold Tth2. The threshold Tth2 is preferably less than the threshold Tth1.

In operation 545, if the average tonality Ta0 is greater than the threshold Tth2 as a result of the comparison in operation 540, all_If is set to 1, and If_att_flag is set to 0 and is not transmitted.

In operation 550, if the average tonality Ta0 is less than or equal to the threshold Tth2 as a result of the comparison in operation 540, all_If is set to 0, and If_att_flag is set as described below and transmitted.

In operation 560, an average tonality Ta1 of bands before Pb is calculated. According to an exemplary embodiment, one or five previous bands may be considered.

In operation 570, the average tonality Ta1 is compared with a threshold Tth3 regardless of a previous frame, or the average tonality Ta1 is compared with a threshold Tth4 when If_aff_flag, i.e., p_If_att_flag, of the previous frame is considered.

In operation 580, if the average tonality Ta1 is greater than the threshold Tth3 as a result of the comparison in operation 570, If_att_flag is set to 1. In operation 590, if the average tonality?Ta1 is less than or equal to the threshold Tth3 as a result of the comparison in operation 570, If_att_flag is set to 0.

When p_If_att_flag is set to 1, in operation 580, if the average tonality Ta1 is greater than the threshold Tth4, If_att_flag is set to 1. At this time, if the previous frame is a transient frame, p_If_att_flag is set to 0. When pIf_att_flag is set to 1, in operation 590, if the average tonality Ta1 is less than or equal to the threshold Tth4, If_att_flag is set to 0. The threshold Tth3 is preferably greater than the threshold Tth4.

When at least one band of which flag(b) is set to 1 exists among the bands of the high frequency signal, all_noise is set to 0 because flag(b) set to 1 indicates that a band having the tone-like characteristic exists in the high frequency signal and therefore all_noise cannot be set to 1. In this case, all_noise is transmitted as 0, and information regarding all_If and If_att_flag is generated by performing operations 540 to 590.

Table 1 below shows a transmission relationship of the BWE parameters generated by the method of FIG. 5. In Table 1, each numeral indicates the number of bits required to transmit a corresponding BWE parameter, and X indicates that a corresponding BWE parameter is not transmitted. The BWE parameters, i.e., all_noise, all_If, and If_att_flag, may have a correlation with f_flag(b) that is the coding band selection information generated by the coding band selection unit 360. For example, when all_noise is set to 1, as shown in Table 1, f_flag, all_If, and If_att_flag do not have to be transmitted. When all_noise is set to 0, f_flag(b) should be transmitted, and information corresponding to the number of bands in the BWE region R1 should be transmitted.

When all_If is set to 0, If_att_flag is set to 0 and is not transmitted. When all_If is set to 1, tatt_flag needs to be transmitted. Transmission may be dependent on the above-described correlation, and transmission may also be possible without the dependent correlation for simplification of a codec structure. As a result, the spectral coding unit 370 performs bit allocation and coding for each band by using residual bits remaining by excluding bits to be used for the BWE parameters and coding band selection information to be transmitted from all the allowable bits.

TABLE 1

| all_noise | f_flag | all_If | If_att_flag | Number of used bits |
|---|---|---|---|---|
| 1 | X | X | X | 1 |
| 0 | # of BWE bands | 1 | 1 | 3 + # of bands in R1 |
| 0 | # of BWE bands | 1 | 0 | 3 + # of bands in R1 |
| 0 | # of BWE bands | 0 | X | 2 + # of bands in R1 |

Referring back to FIG. 3, the multiplexing unit 390 may generate a bitstream including the energy for each band that is provided from the energy coding unit 340, the coding band selection information of the BWE region R1 that is provided from the coding band selection unit 360, the frequency domain coding result of the low frequency coding region R0 and bands R2 in the BWE region R1 that is provided from the spectral coding unit 370, and the BWE parameters that are provided from the BWE parameter coding unit 380 and may store the bitstream in a predetermined storage medium or transmit the bitstream to the decoding end.

Figure 6:
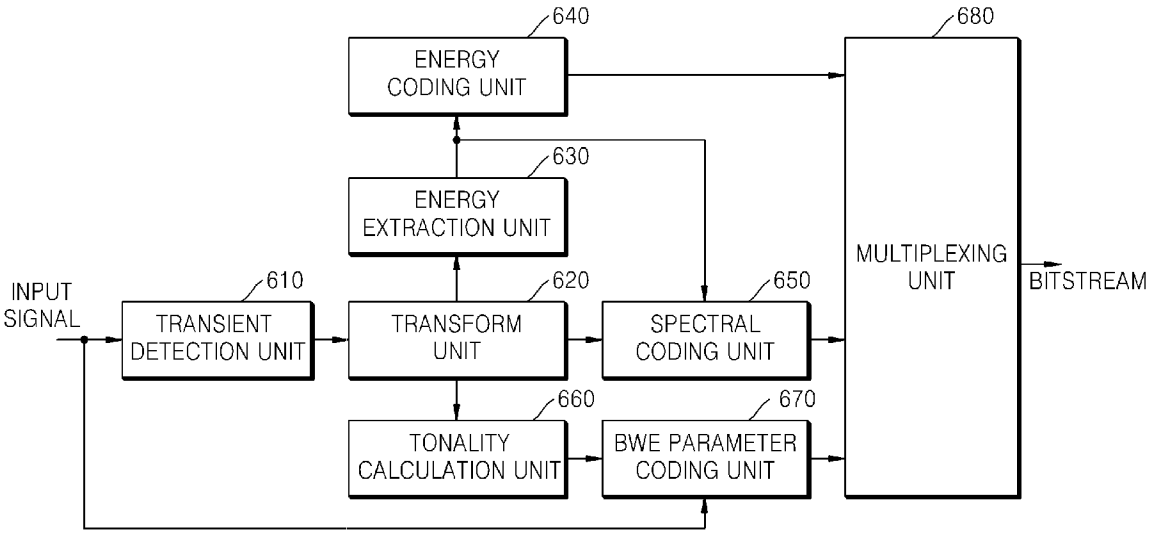
FIG. 6 is a block diagram of an audio encoding apparatus according to another exemplary embodiment.

FIG. 6 is a block diagram of an audio encoding apparatus according to another exemplary embodiment. Basically, the audio encoding apparatus of FIG. 6 may include an element to generate excitation type information for each band, for estimating a weight which is applied to generate a high frequency excitation signal at a decoding end and an element to generate a bitstream including the excitation type information for each band. Some elements may also be optionally included into the audio encoding apparatus.

The audio encoding apparatus shown in FIG. 6 may include a transient detection unit 610, a transform unit 620, an energy extraction unit 630, an energy coding unit 640, a spectral coding unit 650, a tonality calculation unit 660, a BWE parameter coding unit 670, and a multiplexing unit 680. The components may be integrated in at least one module and implemented by at least one processor (not shown). In FIG. 6, the description of the same components as in the audio encoding apparatus of FIG. 3 is not repeated.

Referring to FIG. 6, the spectral coding unit 650 may perform frequency domain coding of spectrum coefficients, for bands of a low frequency signal which is provided from the transform unit 620. The other operations are the same as those of spectral coding unit 370.

The tonality calculation unit 660 may calculate a tonality of the BWE region R1 in frame units.

The BWE parameter coding unit 670 may generate and encode BWE excitation type information or excitation class information by using the tonality of the BWE region R1 that is provided from the tonality calculation unit 660. According to an exemplary embodiment, the BWE excitation type information may be determined by first considering mode information of an input signal. The BWE excitation type information may be transmitted for each frame. For example, when the BWE excitation type information is formed with two bits, the BWE excitation type information may have a value of 0, 1, 2, or 3. The BWE excitation type information may be allocated such that a weight to be added to random noise increases as the BWE excitation type information approaches 0 and decreases as the BWE excitation type information approaches 3. According to an exemplary embodiment, the BWE excitation type information may be set to a value close to 3 as the tonality increases and a value close to 0 as the tonality decreases.

Figure 7:
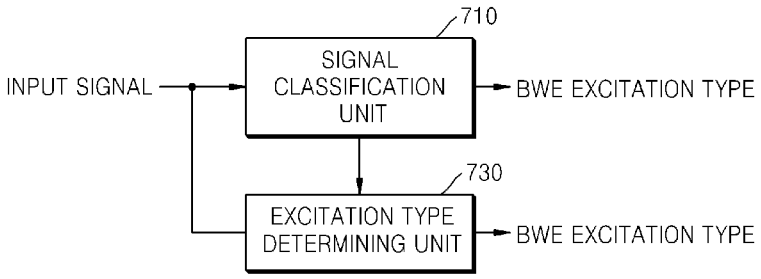
FIG. 7 is a block diagram of a BWE parameter coding unit according to an exemplary embodiment.

FIG. 7 is a block diagram of a BWE parameter coding unit according to an exemplary embodiment. The BWE parameter coding unit shown in FIG. 7 may include a signal classification unit 710 and an excitation type determining unit 730.

A BWE scheme in the frequency domain may be applied by being combined with a time domain coding part. A code excited linear prediction (CELP) scheme may be mainly used for the time domain coding, and the BWE parameter coding unit may be implemented so as to code a low frequency band in the CELP scheme and be combined with the BWE scheme in the time domain other than the BWE scheme in the frequency domain. In this case, a coding scheme may be selectively applied for the entire coding based on adaptive coding scheme determination between time domain coding and frequency domain coding. To select an appropriate coding scheme, signal classification is required, and according to an exemplary embodiment, a weight may be allocated to each band by additionally using a result of the signal classification.

Referring to FIG. 7, the signal classification unit 710 may classify whether a current frame is a speech signal by analyzing a characteristic of an input signal in frame units and determine a BWE excitation type in response to the result of classification. The signal classification may be processed using various well-known methods, e.g., a short-term characteristic and/or a long-term characteristic. When a current frame is mainly classified to a speech signal for which time domain coding is an appropriate coding scheme, a method of adding a fixed-type weight may be more helpful for the improvement of sound quality than a method based on characteristics of a high frequency signal. Signal classification units 1410 and 1510 typically used for an audio encoding apparatus of a switching structure in FIGS. 14 and 15 to be described below may classify a signal of a current frame by combining a result of a plurality of previous frames and a result of the current frame. Thus, by only using a signal classification result of a current frame as an intermediate result, although frequency domain coding is finally applied, when it is output that time domain coding is an appropriate coding scheme for the current frame, a fixed weight may be set to perform encoding. For example, as described above, when the current frame is classified to a speech signal for which time domain coding is appropriate, a BWE excitation type may be set to, for example, 2.

When the current frame is not classified to a speech signal as a result of the classification of the signal classification unit 710, a BWE excitation type may be determined using a plurality of thresholds.

The excitation type determining unit 730 may generate four BWE excitation types of a current frame that is classified not to be a speech signal by segmenting four average tonality regions with three set thresholds. The exemplary embodiment is not limited to the four BWE excitation types, and three or two BWE excitation types may be used according to circumstances, wherein the number and values of thresholds to be used may also be adjusted in correspondence with the number of BWE excitation types. A weight for each frame may be allocated in correspondence with the BWE excitation type information. According to another exemplary embodiment, when more bits can be allocated to the weight for each frame, per-band weight information may be extracted and transmitted.

Figure 8:
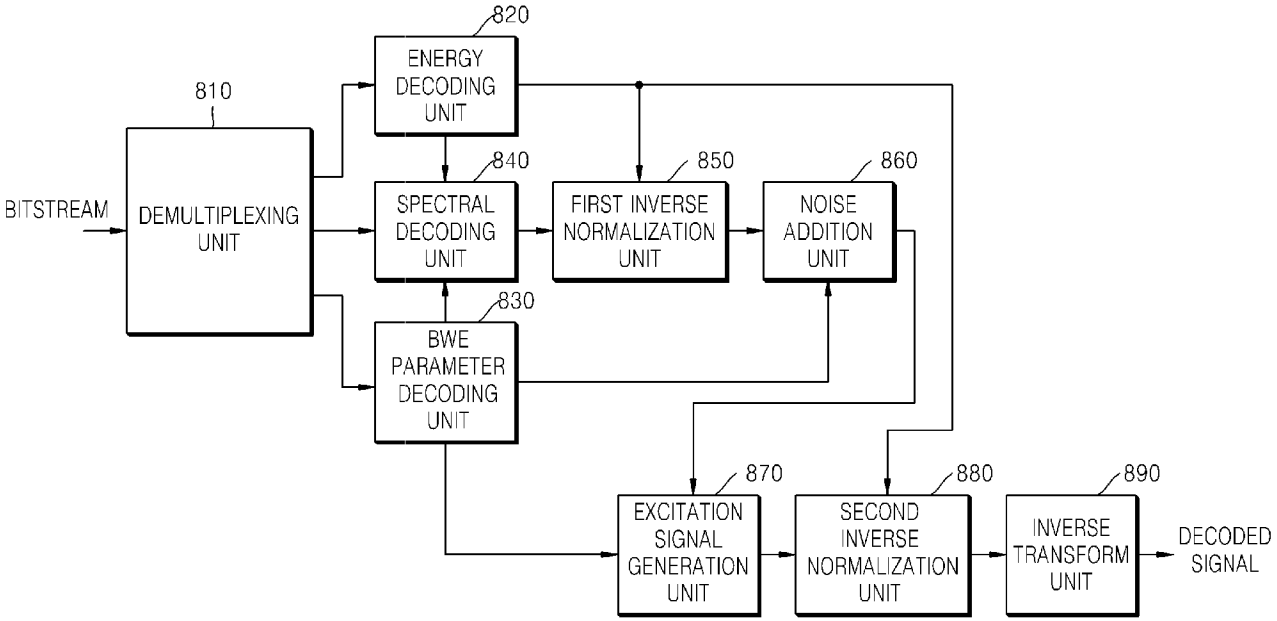
FIG. 8 is a block diagram of an audio decoding apparatus according to an exemplary embodiment.

FIG. 8 is a block diagram of an audio decoding apparatus according to an exemplary embodiment.

The audio decoding apparatus of FIG. 8 may include an element to estimate a weight, and an element to generate a high frequency excitation signal by applying the weight between random noise and a decoded low frequency spectrum. Some elements may also be optionally included into the audio decoding apparatus.

The audio decoding apparatus shown in FIG. 8 may include a demultiplexing unit 810, an energy decoding unit 820, a BWE parameter decoding unit 830, a spectral decoding unit 840, a first inverse normalization unit 850, a noise addition unit 860, an excitation signal generation unit 870, a second inverse normalization unit 880, and an inverse transform unit 890. The components may be integrated in at least one module and implemented by at least one processor (not shown).

Referring to in FIG. 8, the demultiplexing unit 810 may extract encoded energy for each band, a frequency domain coding result of the low frequency coding region R0 and bands R2 in the BWE region R1, and BWE parameters by parsing a bitstream.

At this time, according to a correlation between coding band selection information and the BWE parameters, the coding band selection information may be parsed by the demultiplexing unit 810 or the BWE parameter decoding unit 830.

The energy decoding unit 820 may generate dequantized energy for each band by decoding the encoded energy for each band that is provided from the demultiplexing unit 810. The dequantized energy for each band may be provided to the first and second inverse normalization units 850 and 880. In addition, the dequantized energy for each band may be provided to the spectral decoding unit 840 for bit allocation, similarly to the encoding end.

The BWE parameter decoding unit 830 may decode the BWE parameters that are provided from the demultiplexing unit 810. At this time, when f_flag(b) that is the coding band selection information has a correlation with the BWE parameters, e.g., all_noise, the BWE parameter decoding unit 830 may decode the coding band selection information together with the BWE parameters. According to an exemplary embodiment, when the information all_noise, the information f_flag, the information all_If, and the information If_att_flag have a correlation as shown in Table 1, the decoding may be sequentially performed. The correlation may be changed in another manner, and in a changed case, the decoding may be sequentially performed in a scheme suitable for the changed case. As an example of Table 1, all_noise is first parsed to check whether all_noise is 1 or 0. If all_noise is 1, the information f_flag, the information all_If, and the information If_att_flag are set to 0. If all_noise is 0, the information f_flag is parsed as many times as the number of bands in the BWE region R1, and then the information all_If is parsed. If all_If is 0, If_att_flag is set to 0, and if all_If is 1, If_att_flag is parsed.

When f_flag(b) that is the coding band selection information does not have a correlation with the BWE parameters, the coding band selection information may be parsed as the bitstream by the demultiplexing unit 810 and provided to the spectral decoding unit 840 together with the frequency domain coding result of the low frequency coding region R0 and the bands R2 in the BWE region R1.

The spectral decoding unit 840 may decode the frequency domain coding result of the low frequency coding region R0 and may decode the frequency domain coding result of the bands R2 in the BWE region R1 in correspondence with the coding band selection information. To this end, the spectral decoding unit 840 may use the dequantized energy for each band that is provided from the energy decoding unit 820 and allocate bits to each band by using residual bits remaining by excluding bits used for the parsed BWE parameters and coding band selection information from all the allowable bits. For spectral decoding, lossless decoding and dequantization may be performed, and according to an exemplary embodiment, FPC may be used. That is, the spectral decoding may be performed by using the same schemes as used for the spectral coding at the encoding end.

A band in the BWE region R1 to which bits are allocated and thus actual pulses are allocated since f_flag(b) is set to 1 is classified to a band R2, and a band in the BWE region R1 to which bits are not allocated since f_flag(b) is set to 0 is classified to a band R3. However, a band may exist in the BWE region R1, such that the number of pulses coded in the FPC scheme is 0 since bits cannot be allocated to the band even though spectral decoding should be performed for the band since f_flag(b) is set to 1. Such a band for which coding cannot be performed even though the band is a band R2 set to perform frequency domain coding may be classified to a band R3 instead of a band R2 and processed in the same way as a case where f_flag(b) is set to 0.

The first inverse normalization unit 850 may inverse-normalize the frequency domain coding result that is provided from the spectral decoding unit 840 by using the dequantized energy for each band that is provided from the energy decoding unit 820. The inverse normalization may correspond to a process of matching decoded spectral energy with energy for each band. According to an exemplary embodiment, the inverse normalization may be performed for the low frequency coding region R0 and the bands R2 in the BWE region R1.

The noise addition unit 860 may check each band of a decoded spectrum in the low frequency coding region R0 and separate the band as one of bands R4 and R5. At this time, noise may not be added to a band separated as R5, and noise may be added to a band separated as R4. According to an exemplary embodiment, a noise level to be used when noise is added may be determined based on the density of pulses existing in a band. That is, the noise level may be determined based on coded pulse energy, and random energy may be generated using the noise level. According to another exemplary embodiment, a noise level may be transmitted from the encoding end. A noise level may be adjusted based on the information If_att_flag. According to an exemplary embodiment, if a predetermined condition is satisfied as described below, a noise level NI may be updated by Att_factor.

```
if (all__noise==0 && all__If==1 && If__att__flag==1)
    {
        ni__gain = ni__coef * NI * Att__factor;
    }
        else
    {
        ni__gain = ni__coef * Ni;
    }
```

where ni_gain denotes a gain to be applied to final noise, ni_coef denotes a random seed, and Att_factor denotes an adjustment constant.

The excitation signal generation unit 870 may generate a high frequency excitation signal by using a decoded low frequency spectrum that is provided from the noise addition unit 860 in correspondence with the coding band selection information regarding each band in the BWE region R1.

The second inverse normalization unit 880 may inverse-normalize the high frequency excitation signal that is provided from the excitation signal generation unit 870 by using the dequantized energy for each band that is provided from the energy decoding unit 820, to generate a high frequency spectrum. The inverse normalization may correspond to a process of matching energy in the BWE region R1 with energy for each band.

The inverse transform unit 890 may generate a decoded signal in the time domain by inverse-transforming the high frequency spectrum that is provided from the second inverse normalization unit 880.

Figure 9:
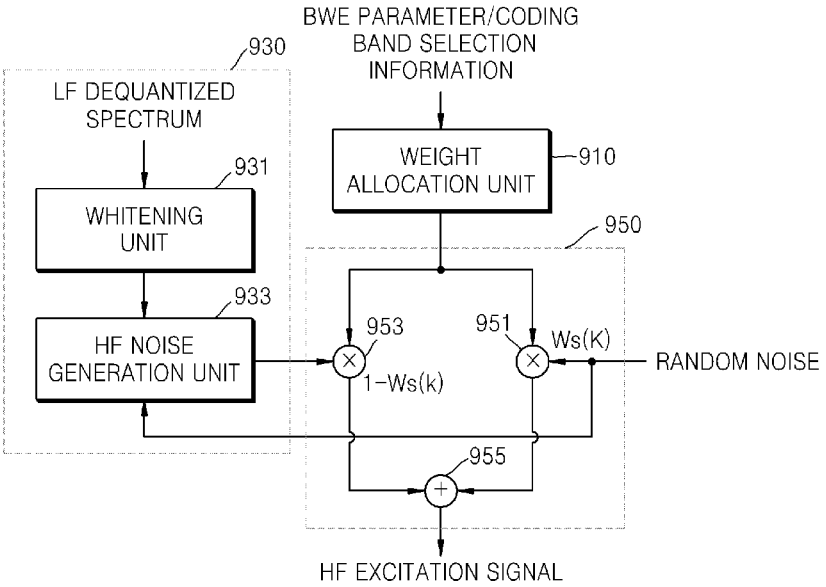
FIG. 9 is a block diagram of an excitation signal generation unit according to an exemplary embodiment.

FIG. 9 is a block diagram of an excitation signal generation unit according to an exemplary embodiment, wherein the excitation signal generation unit may generate an excitation signal for a band R3 in the BWE region R1, i.e., a band to which no bits are allocated.

The excitation signal generation unit shown in FIG. 9 may include a weight allocation unit 910, a noise signal generation unit 930, and a computation unit 950. The components may be integrated in at least one module and implemented by at least one processor (not shown).

Referring to FIG. 9, the weight allocation unit 910 may allocate a weight for each band. The weight indicates a mixed ratio of a high frequency (HF) noise signal, which is generated based on a decoded low frequency signal and random noise, to the random noise. In detail, an HF excitation signal He(f,k) may be represented by Equation 3.

$$He(f,k)=(1-Ws(f,k))*Hn(f,k)+Ws(f,k)*Rn(f,k) \quad (3)$$

In Equation 3, Ws(f,k) denotes a weight, f denotes a frequency index, k denotes a band index, Hn denotes an HF noise signal, and Rn denotes random noise.

Although a weight Ws(f,k) has the same value in one band, the weight Ws(f,k) may be processed to be smoothed according to a weight of an adjacent band at a band boundary.

The weight allocation unit 910 may allocate a weight for each band by using the BWE parameters and the coding band selection information, e.g., the information all_noise, the information all_If, the information If_att_flag, and the information f_flag. In detail, when all_noise=1, the weight is allocated as Ws(k)=w0 (for all k). When all_noise=0, the weight is allocated for bands R2 as Ws(k)=w4. In addition, for bands R3, when all_noise=0, all_If=1, and If_att_flag=1, the weight is allocated as Ws(k)=w3, when all_noise=0, all_If=1, and tatt_flag=0, the weight is allocated as Ws(k)=w2, and in the other cases, the weight is allocated as Ws(k)=w1. According to an exemplary embodiment, it may be allocated that w0=1, w1=0.65, w2=0.55, w3=0.4, w4=0. It may be preferably set to gradually decrease from w0 to w4.

The weight allocation unit 910 may smooth the allocated weight Ws(k) for each band by considering weights Ws(k−1) and Ws(k+1) of adjacent bands. As a result of the smoothing, the weight Ws(f,k) of a band k may have a different value according to a frequency f.

Figure 12:
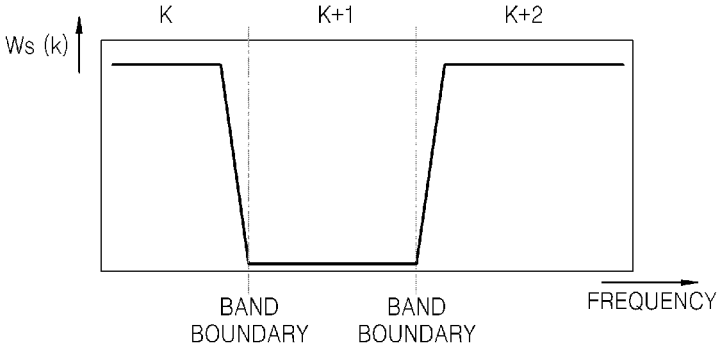
FIG. 12 is a graph for describing smoothing a weight at a band edge.

FIG. 12 is a graph for describing smoothing a weight at a band boundary. Referring to FIG. 12, since a weight of a (K+2)th band and a weight of a (K+1)th band are different from each other, smoothing is necessary at a band boundary. In the example of FIG. 12, smoothing is not performed for the (K+1)th band and is only performed for the (K+2)th band because a weight Ws(K+1) of the (K+1)th band is 0, and when smoothing is performed for the (K+1)th band, the weight Ws(K+1) of the (K+1)th band is not zero, and in this case, random noise in the(K+1)th band also should be considered. That is, a weight of 0 indicates that random noise is not considered in a corresponding band when an HF excitation signal is generated. The weight of 0 corresponds to an extreme tone signal, and random noise is not considered to prevent a noise sound from being generated by noise inserted into a valley duration of a harmonic signal due to the random noise.

The weight Ws(f,k) determined by the weight allocation unit 910 may be provided to the computation unit 950 and may be applied to the HF noise signal Hn and the random noise Rn.

The noise signal generation unit 930 may generate an HF noise signal and may include a whitening unit 931 and an HF noise generation unit 933.

The whitening unit 931 may perform whitening of a dequantized low frequency spectrum. Various well-known methods may be applied for the whitening. For example, a method of segmenting the dequantized low frequency spectrum into a plurality of uniform blocks, obtaining an average of absolute values of spectral coefficients for each block, and dividing the spectral coefficients in each block by the average.

The HF noise generation unit 933 may generate an HF noise signal by duplicating the low frequency spectrum provided from the whitening unit 931 to a high frequency band, i.e., the BWE region R1, and matching a level to random noise. The duplication process to the high frequency band may be performed by patching, folding, or copying under preset rules of the encoding end and the decoding end and may be variably applied according to a bit rate. The level matching indicates matching an average of random noise with an average of a signal obtained by duplicating the whitening-processed signal into a high frequency band for all the bands in the BWE region R1. According to an exemplary embodiment, the average of the signal obtained by duplicating the whitening-processed signal to a high frequency band may be set to be a little greater than the average of random noise because it may be considered that random noise has a flat characteristic since random noise is a random signal, and since a low frequency (LF) signal may have a relatively wide dynamic range, although an average of magnitudes is matched, small energy may be generated.

The computation unit 950 may generate an HF excitation signal for each band by applying a weight to the random noise and the HF noise signal. The computation unit 950 may include first and second multipliers 951 and 953 and an adder 955. The random noise may be generated in various well-known methods, for example, using a random seed.

The first multiplier 951 multiplies the random noise by a first weight Ws(k), the second multiplier 953 multiplies the HF noise signal by a second weight 1-Ws(k), and the adder 955 adds the multiplication result of the first multiplier 951 and the multiplication result of the second multiplier 953 to generate an HF excitation signal for each band.

Figure 10:
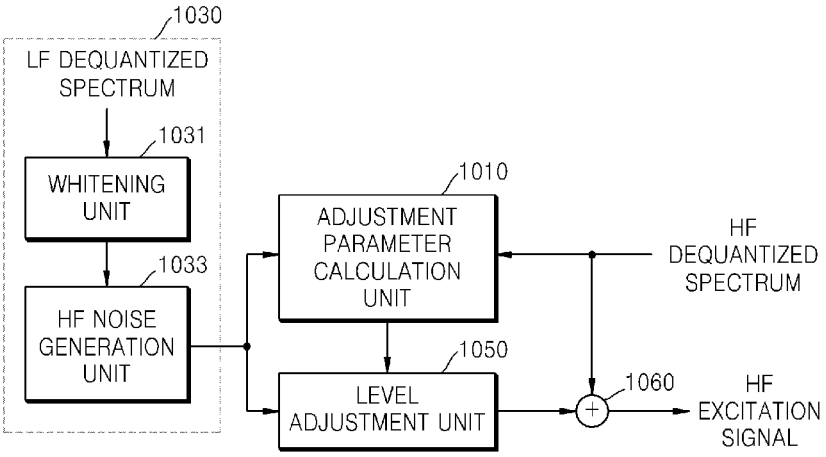
FIG. 10 is a block diagram of an excitation signal generation unit according to another exemplary embodiment.

FIG. 10 is a block diagram of an excitation signal generation unit according to another exemplary embodiment, wherein the excitation signal generation unit may generate an excitation signal for a band R2 in the BWE region R1, i.e., a band to which bits are allocated.

The excitation signal generation unit shown in FIG. 10 may include an adjustment parameter calculation unit 1010, a noise signal generation unit 1030, a level adjustment unit 1050, and a computation unit 1060. The components may be integrated in at least one module and implemented by at least one processor (not shown).

Referring to FIG. 10, since the band R2 has pulses coded by FPC, level adjustment may be further added to the generation of an HF excitation signal using a weight. Random noise is not added to the band R2 for which frequency domain coding has been performed. FIG. 10 illustrates a case where the weight Ws(k) is 0, and when the weight Ws(k) is not zero, an HF noise signal is generated in the same way as in the noise signal generation unit 930 of FIG. 9, and the generated HF noise signal is mapped as an output of the noise signal generation unit 1030 of FIG. 10. That is, the output of the noise signal generation unit 1030 of FIG. 10 is the same as an output of the noise signal generation unit 930 of FIG. 9.

The adjustment parameter calculation unit 1010 calculates a parameter to be used for level adjustment. When a dequantized FPC signal for the band R2 is defined as C(k), a maximum value of an absolute value is selected from C(k), the selected value is defined as Ap, and a position of a non-zero value as a result of FPC is defined as CPs. Energy of a signal N(k) (the output of the noise signal generation unit 1030 is obtained at a position other than CPs and is defined as En. An adjustment parameter γ may be obtained using Equation 4 based on En, Ap, and Tth0 that is used to set f_flag(b) in encoding.

$$\gamma = \sqrt{\frac{A_p^2}{E_n}} * 10^{-Tth0} * Attfactor \quad (4)$$

In Equation 4, att_factor denotes an adjustment constant.

The computation unit 1060 may generate an HF excitation signal by multiplying the adjustment parameter γ by the noise signal N(k) provided from the noise signal generation unit 1030.

Figure 11:
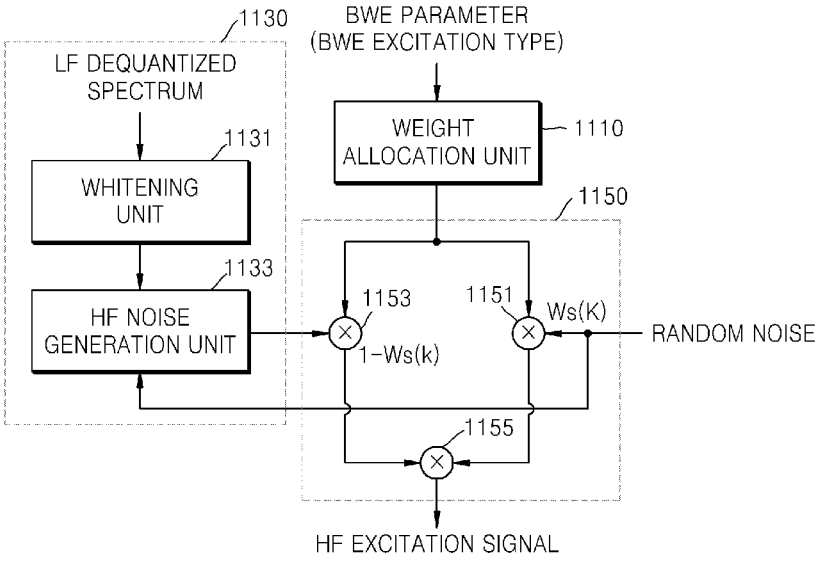
FIG. 11 is a block diagram of an excitation signal generation unit according to another exemplary embodiment.

FIG. 11 is a block diagram of an excitation signal generation unit according to another exemplary embodiment, wherein the excitation signal generation unit may generate an excitation signal for all the bands in the BWE region R1.

The excitation signal generation unit shown in FIG. 11 may include a weight allocation unit 1110, a noise signal generation unit 1130, and a computation unit 1150. The components may be integrated in at least one module and implemented by at least one processor (not shown). Since the noise signal generation unit 1130 and the computation unit 1150 are the same as the noise signal generation unit 930 and the computation unit 950 of FIG. 9, the description thereof is not repeated.

Referring to FIG. 11, the weight allocation unit 1110 may allocate a weight for each frame. The weight indicates a mixed ratio of an HF noise signal, which is generated based on a decoded LF signal and random noise, to the random noise.

The weight allocation unit 1110 receives BWE excitation type information parsed from a bitstream. The weight allocation unit 1110 sets Ws(k)=w00 (for all k) when a BWE excitation type is 0, sets Ws(k)=w01 (for all k) when the BWE excitation type is 1, sets Ws(k)=w02 (for all k) when the BWE excitation type is 2, and sets Ws(k)=w03 (for all k) when the BWE excitation type is 3. According to an embodiment of the present invention, it may be allocated that w00=0.8, w01=0.5, w02=0.25, and w03=0.05. It may be set to gradually decrease from w00 to w03. Likewise, smoothing may be performed for the allocated weight.

A preset same weight may be applied to bands after a specific frequency in the BWE region R1 regardless of the BWE excitation type information. According to an exemplary embodiment, a same weight may be always used for a plurality of bands including the last band after the specific frequency in the BWE region R1, and a weight may be generated for bands before the specific frequency based on the BWE excitation type information. For example, for bands to which frequencies of 12 KHz or over belong, w02 may be allocated to all values of Ws(k). As a result, since a region of bands for which an average value of tonalities is obtained to determine a BWE excitation type at the encoding end can be limited to a specific frequency or below even in the BWE region R1, the complexity of computations may be reduced. According to an exemplary embodiment, for a specific frequency or below, i.e. a low frequency part in the BWE region R1, the excitation type may be determined by means of an average of tonalities and the determined excitation type may also be applied to the specific frequency or higher, i.e. a high frequency part in the BWE region R1. That is, since only one piece of excitation class information in frame units is transmitted, when a region for estimating excitation class information is narrow, accuracy may be increased by as much as the narrow region, thereby improving restored sound quality. For a high frequency band in the BWE region R1, the possibility of sound quality degradation may be small even though a same excitation class is applied. In addition, when BWE excitation type information is transmitted for each band, bits to be used to indicate the BWE excitation type information may be reduced.

When a scheme, e.g., a vector quantization (VQ) scheme, other than an energy transmission scheme of a low frequency is applied to energy of a high frequency, energy of the low frequency may be transmitted using lossless coding after scalar quantization, and the energy of the high frequency may be transmitted after quantization in another scheme. In this case, the last band in the low frequency coding region R0 and the first band in the BWE region R1 may overlap each other. In addition, the bands in the BWE region R1 may be configured in another scheme to have a relatively dense band allocation structure.

For example, it may be configured that the last band in the low frequency coding region R0 ends at 8.2 KHz and the first band in the BWE region R1 begins from 8 KHz. In this case, an overlap region exists between the low frequency coding region R0 and the BWE region R1. As a result, two decoded spectra may be generated in the overlap region. One is a spectrum generated by applying a decoding scheme for a low frequency, and the other one is a spectrum generated by applying a decoding scheme for a high frequency. An overlap and add scheme may be applied so that transition between the two spectra, i.e., the decoded spectrum of the low frequency and the decoded spectrum of the high frequency is more smoothed. That is, the overlap region may be reconfigured by simultaneously using the two spectra, wherein a contribution of a spectrum generated in a low frequency scheme is increased for a spectrum close to the low frequency in the overlap region, and a contribution of a spectrum generated in a high frequency scheme is increased for a spectrum close to the high frequency in the overlap region.

For example, when the last band in the low frequency coding region R0 ends at 8.2 KHz and the first band in the BWE region R1 begins from 8 KHz, if 640 sampled spectra are constructed at a sampling rate of 32 KHz, eight spectra, i.e., $320^{th}$ to $327^{th}$ spectra, overlap, and the eight spectra may be generated using Equation 5.

$$\overline{S}(k)=\overline{S}_l(k)\times w_o(k-L0)+(1-w_o(k-L0))\times\overline{S}_h(k) \quad (5)$$

where L0≤k≤L1. In Equation 5, $\overline{S}_l(k)$ denotes a spectrum decoded in a low frequency scheme, $\overline{S}_h(k)$ denotes a spectrum decoded in a high frequency scheme, L0 denotes a position of a start spectrum of a high frequency, L0~L1 denotes an overlap region, and $w_o$ denotes a contribution.

Figure 13:
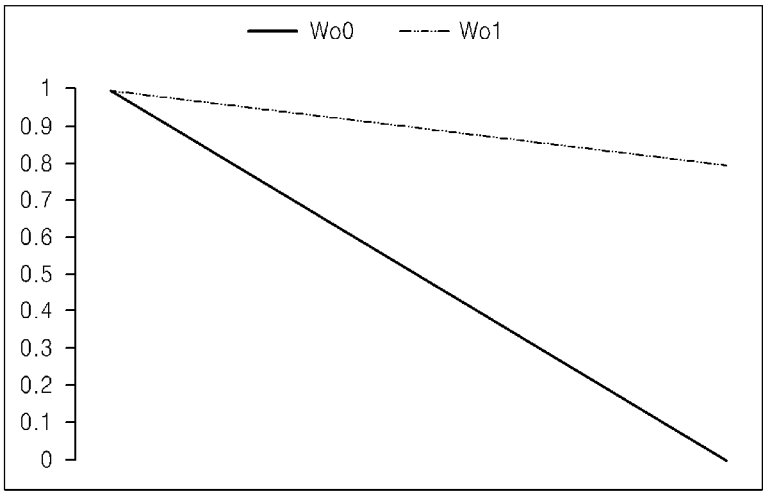
FIG. 13 is a graph for describing a weight that is a contribution to be used to reconstruct a spectrum existing in an overlap region, according to an exemplary embodiment.

FIG. 13 is a graph for describing a contribution to be used to generate a spectrum existing in an overlap region after BWE processing at the decoding end, according to an exemplary embodiment.

Referring to FIG. 13, and may be selectively applied to wherein $w_{o0}(k)$ indicates that the same weight is applied to LF and HF decoding schemes, and $w_{o1}(k)$ indicates that a greater weight is applied to the HF decoding scheme. A selection criterion for $w_o(k)$ is whether pulses using FPC have been selected in an overlapping band of a low frequency. When pulses in the overlapping band of the low frequency have been selected and coded, $w_{o0}(k)$ is used to make a contribution for a spectrum generated at the low frequency valid up to the vicinity of L1, and a contribution of a high frequency is decreased. Basically, a spectrum generated in an actual coding scheme may have higher proximity to an original signal than a spectrum of a signal generated by BWE. By using this, in an overlapping band, a scheme for increasing a contribution of a spectrum closer to an original signal may be applied, and accordingly, a smoothing effect and improvement of sound quality may be expected.

Figure 14:
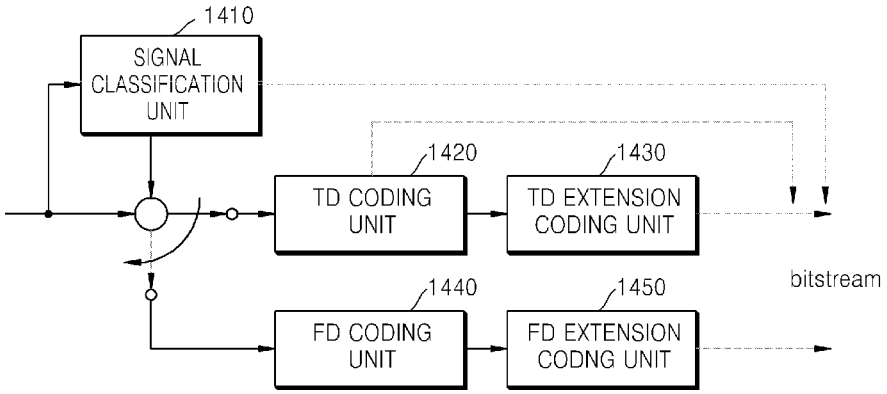
FIG. 14 is a block diagram of an audio encoding apparatus of a switching structure, according to an exemplary embodiment.

FIG. 14 is a block diagram of an audio encoding apparatus of a switching structure, according to an exemplary embodiment.

The audio encoding apparatus shown in FIG. 14 may include a signal classification unit 1410, a time domain (TD) coding unit 1420, a TD extension coding unit 1430, a frequency domain (FD) coding unit 1440, and an FD extension coding unit 1450.

The signal classification unit 1410 may determine a coding mode of an input signal by referring to a characteristic of the input signal. The signal classification unit 1410 may determine a coding mode of the input signal by considering a TD characteristic and an FD characteristic of the input signal. In addition, the signal classification unit 1410 may determine that TD coding of the input signal is performed when the characteristic of the input signal corresponds to a speech signal and that FD coding of the input signal is performed when the characteristic of the input signal corresponds to an audio signal other than a speech signal.

The input signal input to the signal classification unit 1410 may be a signal down-sampled by a down-sampling unit (not shown). According to an exemplary embodiment, the input signal may a signal having a sampling rate of 12.8 KHz or 16 KHz, which is obtained by resampling a signal having a sampling rate of 32 KHz or 48 KHz. In this case, the signal having a sampling rate of 32 KHz may be a super wideband (SWB) signal that may be a full band (FB) signal. In addition, the signal having a sampling rate of 16 KHz may be a wideband (WB) signal.

Accordingly, the signal classification unit 1410 may determine a coding mode of an LF signal existing in an LF region of the input signal as any one of a TD mode and an FD mode by referring to a characteristic of the LF signal.

The TD coding unit 1420 may perform CELP coding on the input signal when the coding mode of the input signal is determined as the TD mode. The TD coding unit 1420 may extract an excitation signal from the input signal and quantize the extracted excitation signal by considering adaptive codebook contribution and fixed codebook contribution that correspond to pitch information.

According to another exemplary embodiment, the TD coding unit 1420 may further include extracting a linear prediction coefficient (LPC) from the input signal, quantizing the extracted LPC, and extracting an excitation signal by using the quantized LPC.

In addition, the TD coding unit 1420 may perform the CELP coding in various coding modes according to characteristics of the input signal. For example, the TD coding unit 1420 may perform the CELP coding on the input signal in any one of a voiced coding mode, an unvoiced coding mode, a transition mode, and a generic coding mode.

The TD extension coding unit 1430 may perform extension coding on an HF signal in the input signal when the CELP coding is performed on the LF signal in the input signal. For example, the TD extension coding unit 1430 may quantize an LPC of the HF signal corresponding to an HF region of the input signal. At this time, the TD extension coding unit 1430 may extract the LPC of the HF signal in the input signal and quantize the extracted LPC. According to an exemplary embodiment, the TD extension coding unit 1430 may generate the LPC of the HF signal in the input signal by using the excitation signal of the LF signal in the input signal.

The FD coding unit 1440 may perform FD coding on the input signal when the coding mode of the input signal is determined as the FD mode. To this end, the FD coding unit 1440 may transform the input signal to a frequency spectrum in the frequency domain by using MDCT or the like and quantize and lossless-code the transformed frequency spectrum. According to an exemplary embodiment, FPC may be applied thereto.

The FD extension coding unit 1450 may perform extension coding on the HF signal in the input signal. According to an exemplary embodiment, the FD extension coding unit 1450 may perform FD extension by using an LF spectrum.

Figure 15:
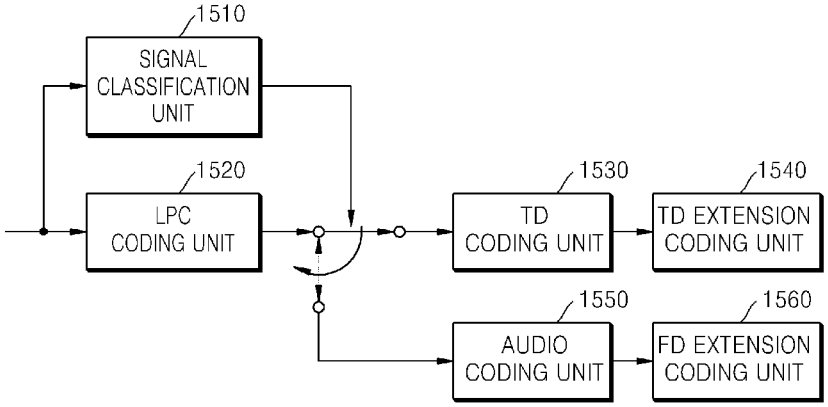
FIG. 15 is a block diagram of an audio encoding apparatus of a switching structure, according to another exemplary embodiment.

FIG. 15 is a block diagram of an audio encoding apparatus of a switching structure, according to another exemplary embodiment.

The audio encoding apparatus shown in FIG. 15 may include a signal classification unit 1510, an LPC coding unit 1520, a TD coding unit 1530, a TD extension coding unit 1540, an audio coding unit 1550, and an FD extension coding unit 1560.

Referring to FIG. 15, the signal classification unit 1510 may determine a coding mode of an input signal by referring to a characteristic of the input signal. The signal classification unit 1510 may determine a coding mode of the input signal by considering a TD characteristic and an FD characteristic of the input signal. The signal classification unit 1510 may determine that TD coding of the input signal is performed when the characteristic of the input signal corresponds to a speech signal and that audio coding of the input signal is performed when the characteristic of the input signal corresponds to an audio signal other than a speech signal.

The LPC coding unit 1520 may extract an LPC from the input signal and quantizes the extracted LPC. According to an exemplary embodiment, the LPC coding unit 1520 may quantize the LPC by using a trellis coded quantization (TCQ) scheme, a multi-stage vector quantization (MSVQ) scheme, a lattice vector quantization (LVQ) scheme, or the like but it is not limited thereto.

In detail, the LPC coding unit 1520 may extract the LPC from an LF signal in the input signal, which has a sampling rate of 12.8 KHz or 16 KHz, by resampling the input signal having a sampling rate of 32 KHz or 48 KHz. The LPC coding unit 1520 may further include extracting an LPC excitation signal by using the quantized LPC.

The TD coding unit 1530 may perform CELP coding on the LPC excitation signal extracted using the LPC when the coding mode of the input signal is determined as the TD mode. For example, the TD coding unit 1530 may quantize the LPC excitation signal by considering adaptive codebook contribution and fixed codebook contribution that correspond to pitch information. The LPC excitation signal may be generated by at least one of the LPC coding unit 1520 and the TD coding unit 1530.

The TD extension coding unit 1540 may perform extension coding on an HF signal in the input signal when the CELP coding is performed on the LPC excitation signal of the LF signal in the input signal. For example, the TD extension coding unit 1540 may quantize an LPC of the HF signal in the input signal. According to an embodiment of the present invention, the TD extension coding unit 1540 may extract the LPC of the HF signal in the input signal by using the LPC excitation signal of the LF signal in the input signal.

The audio coding unit 1550 may perform audio coding on the LPC excitation signal extracted using the LPC when the coding mode of the input signal is determined as the audio mode. For example, the audio coding unit 1550 may transform the LPC excitation signal extracted using the LPC to an LPC excitation spectrum in the frequency domain and quantizes the transformed LPC excitation spectrum. The audio coding unit 1550 may quantize the LPC excitation spectrum, which has been transformed in the frequency domain, in the FPC scheme or the LVQ scheme.

In addition, the audio coding unit 1550 may quantize the LPC excitation spectrum by further considering TD coding information, such as adaptive codebook contribution and fixed codebook contribution, when marginal bits exist in the quantization of the LPC excitation spectrum.

The FD extension coding unit 1560 may perform extension coding on the HF signal in the input signal when the audio coding is performed on the LPC excitation signal of the LF signal in the input signal. That is, the FD extension coding unit 1560 may perform HF extension coding by using an LF spectrum.

The FD extension coding units 1450 and 1560 may be implemented by the audio encoding apparatus of FIG. 3 or 6.

Figure 16:
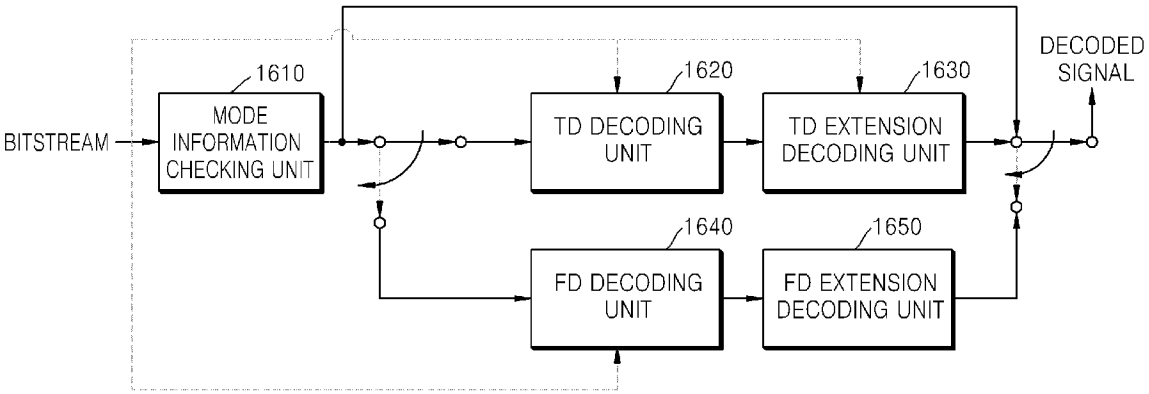
FIG. 16 is a block diagram of an audio decoding apparatus of a switching structure, according to an exemplary embodiment.

FIG. 16 is a block diagram of an audio decoding apparatus of a switching structure, according to an exemplary embodiment.

Referring to FIG. 16, the audio decoding apparatus may include a mode information checking unit 1610, a TD decoding unit 1620, a TD extension decoding unit 1630, an FD decoding unit 1640, and an FD extension decoding unit 1650.

The mode information checking unit 1610 may check mode information of each of frames included in a bitstream. The mode information checking unit 1610 may parse the mode information from the bitstream and switch to any one of a TD decoding mode and an FD decoding mode according to a coding mode of a current frame from the parsing result.

In detail, the mode information checking unit 1610 may switch to perform CELP decoding on a frame coded in the TD mode and perform FD decoding on a frame coded in the FD mode for each of the frames included in the bitstream.

The TD decoding unit 1620 may perform CELP decoding on a CELP-coded frame according to the checking result. For example, the TD decoding unit 1620 may generate an LF signal that is a decoding signal for a low frequency by decoding an LPC included in the bitstream, decoding adaptive codebook contribution and fixed codebook contribution, and synthesizing the decoding results.

The TD extension decoding unit 1630 may generate a decoding signal for a high frequency by using at least one of the CELP-decoded result and an excitation signal of the LF signal. The excitation signal of the LF signal may be included in the bitstream. In addition, the TD extension decoding unit 1630 may use LPC information regarding an HF signal, which is included in the bitstream, to generate the HF signal that is the decoding signal for the high frequency.

According to an exemplary embodiment, the TD extension decoding unit 1630 may generate a decoded signal by synthesizing the generated HF signal and the LF signal generated by the TD decoding unit 1620. At this time, the TD extension decoding unit 1630 may further include converting sampling rates of the LF signal and the HF signal to be the same to generate the decoded signal.

The FD decoding unit 1640 may perform FD decoding on an FD-coded frame according to the checking result. According to an exemplary embodiment, the FD decoding unit 1640 may perform lossless decoding and dequantizing by referring to mode information of a previous frame included in the bitstream. At this time, FPC decoding may be applied, and noise may be added to a predetermined frequency band as a result of the FPC decoding.

The FD extension decoding unit 1650 may perform HF extension decoding by using a result of the FPC decoding and/or noise filling in the FD decoding unit 1640. The FD extension decoding unit 1650 may generate a decoded HF signal by dequantizing energy of a decoded frequency spectrum for an LF band, generating an excitation signal of the HF signal by using the LF signal according to any one of various HF BWE modes, and applying a gain so that energy of the generated excitation signal is symmetrical to the dequantized energy. For example, the HF BWE mode may be any one of a normal mode, a harmonic mode, and a noise mode.

Figure 17:
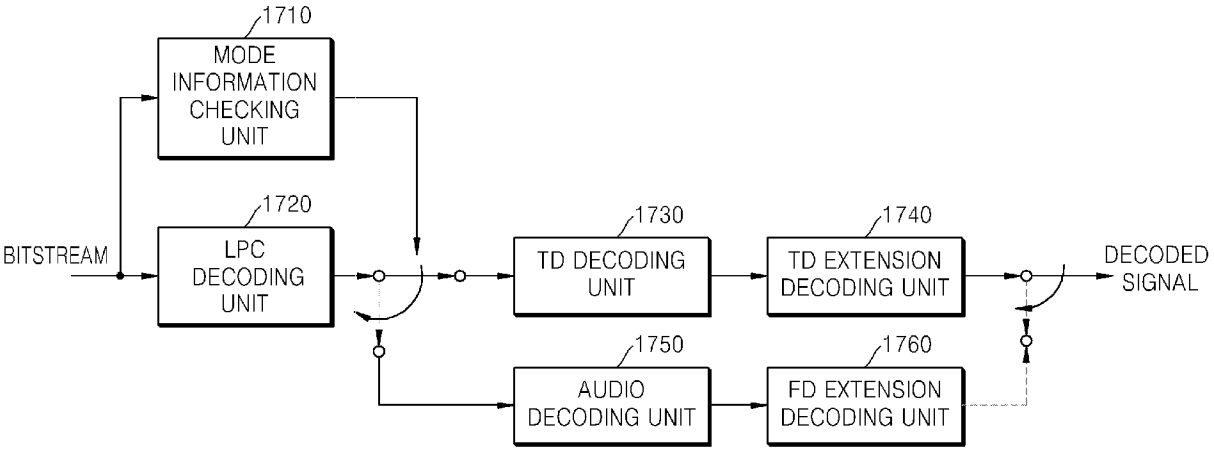
FIG. 17 is a block diagram of an audio decoding apparatus of a switching structure, according to another exemplary embodiment.

FIG. 17 is a block diagram of an audio decoding apparatus of a switching structure, according to another exemplary embodiment.

Referring to FIG. 17, the audio decoding apparatus may include a mode information checking unit 1710, an LPC decoding unit 1720, a TD decoding unit 1730, a TD extension decoding unit 1740, an audio decoding unit 1750, and an FD extension decoding unit 1760.

The mode information checking unit 1710 may check mode information of each of frames included in a bitstream. For example, the mode information checking unit 1710 may parse mode information from an encoded bitstream and switch to any one of a TD decoding mode and an audio decoding mode according to a coding mode of a current frame from the parsing result.

In detail, the mode information checking unit 1710 may switch to perform CELP decoding on a frame coded in the TD mode and perform audio decoding on a frame coded in the audio mode for each of the frames included in the bitstream.

The LPC decoding unit 1720 may LPC-decode the frames included in the bitstream.

The TD decoding unit 1730 may perform CELP decoding on a CELP-coded frame according to the checking result. For example, the TD decoding unit 1730 may generate an LF signal that is a decoding signal for a low frequency by decoding adaptive codebook contribution and fixed codebook contribution and synthesizing the decoding results.

The TD extension decoding unit 1740 may generate a decoding signal for a high frequency by using at least one of the CELP-decoded result and an excitation signal of the LF signal. The excitation signal of the LF signal may be included in the bitstream. In addition, the TD extension decoding unit 1740 may use LPC information decoded by the LPC decoding unit 1720 to generate an HF signal that is the decoding signal for the high frequency.

According to an exemplary embodiment, the TD extension decoding unit 1740 may generate a decoded signal by synthesizing the generated HF signal and the LF signal generated by the TD decoding unit 1730. At this time, the TD extension decoding unit 1740 may further include converting sampling rates of the LF signal and the HF signal to be the same to generate the decoded signal.

The audio decoding unit 1750 may perform audio decoding on an audio-coded frame according to the checking result. For example, the audio decoding unit 1750 may perform decoding by considering a TD contribution and an FD contribution when the TD contribution exists and by considering the FD contribution when the TD contribution does not exist.

In addition, the audio decoding unit 1750 may generate a decoded LF signal by transforming a signal quantized in the FPC or LVQ scheme to the time domain to generate a decoded LF excitation signal and synthesizing the generated excitation signal to dequantized LPC coefficients.

The FD extension decoding unit 1760 may perform extension decoding by using a result of the audio decoding result. For example, the FD extension decoding unit 1760 may convert a sampling rate of the decoded LF signal to a sampling rate suitable for HF extension decoding and perform frequency transform of the converted signal by using MDCT or the like. The FD extension decoding unit 1760 may generate a decoded HF signal by dequantizing energy of a transformed LF spectrum, generating an excitation signal of the HF signal by using the LF signal according to any one of various HF BWE modes, and applying a gain so that energy of the generated excitation signal is symmetrical to the dequantized energy. For example, the HF BWE mode may be any one of the normal mode, a transient mode, the harmonic mode, and the noise mode.

In addition, the FD extension decoding unit 1760 may transform the decoded HF signal to a signal in the time domain by using inverse MDCT, perform conversion to match a sampling rate of the signal transformed to the time domain with a sampling rate of the LF signal generated by the audio decoding unit 1750, and synthesize the LF signal and the converted signal.

The FD extension decoding units 1650 and 1760 shown in FIGS. 16 and 17 may be implemented by the audio decoding apparatus of FIG. 8.

Figure 18:
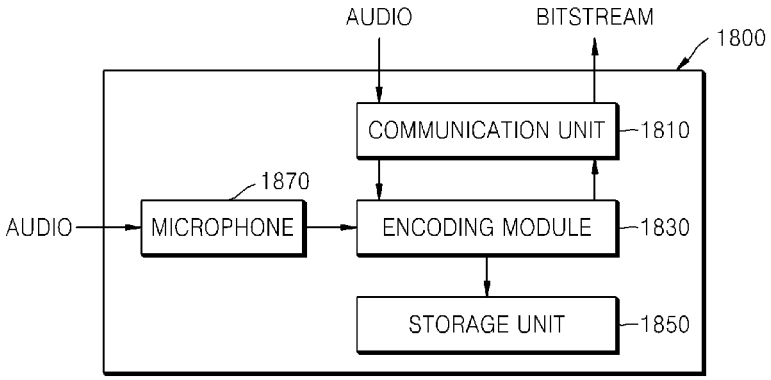
FIG. 18 is a block diagram of a multimedia device including an encoding module, according to an exemplary embodiment.

FIG. 18 is a block diagram of a multimedia device including an encoding module, according to an exemplary embodiment.

Referring to FIG. 18, the multimedia device 1800 may include a communication unit 1810 and the encoding module 1830. In addition, the multimedia device 1800 may further include a storage unit 1850 for storing an audio bitstream obtained as a result of encoding according to the usage of the audio bitstream. Moreover, the multimedia device 1800 may further include a microphone 1870. That is, the storage unit 1850 and the microphone 1870 may be optionally included. The multimedia device 1800 may further include an arbitrary decoding module (not shown), e.g., a decoding module for performing a general decoding function or a decoding module according to an exemplary embodiment. The encoding module 1830 may be implemented by at least one processor, e.g., a central processing unit (not shown) by being integrated with other components (not shown) included in the multimedia device 1800 as one body.

The communication unit 1810 may receive at least one of an audio signal or an encoded bitstream provided from the outside or transmit at least one of a restored audio signal or an encoded bitstream obtained as a result of encoding by the encoding module 1830.

The communication unit 1810 is configured to transmit and receive data to and from an external multimedia device through a wireless network, such as wireless Internet, wireless intranet, a wireless telephone network, a wireless Local Area Network (LAN), Wi-Fi, Wi-Fi Direct (WFD), third generation (3G), fourth generation (4G), Bluetooth, Infrared Data Association (IrDA), Radio Frequency Identification (RFID), Ultra WideBand (UWB), Zigbee, or Near Field Communication (NFC), or a wired network, such as a wired telephone network or wired Internet.

According to an exemplary embodiment, the encoding module 1830 may encode an audio signal in the time domain, which is provided through the communication unit 1810 or the microphone 1870, by using an encoding apparatus of FIG. 14 or 15. In addition, FD extension encoding may be performed by using an encoding apparatus of FIG. 3 or 6.

The storage unit 1850 may store the encoded bitstream generated by the encoding module 1830. In addition, the storage unit 1850 may store various programs required to operate the multimedia device 1800.

The microphone 1870 may provide an audio signal from a user or the outside to the encoding module 1830.

Figure 19:
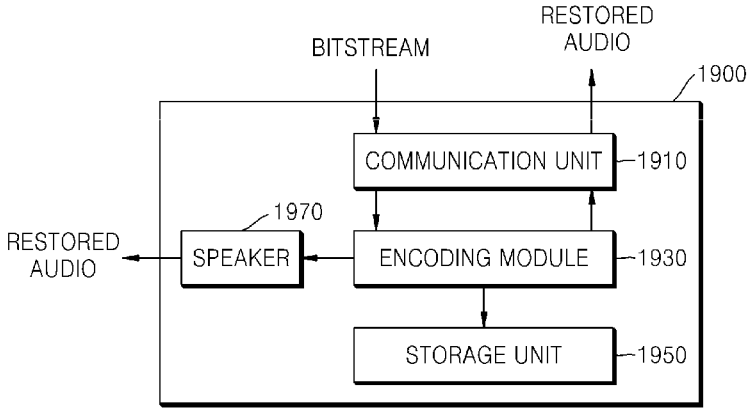
FIG. 19 is a block diagram of a multimedia device including a decoding module, according to an exemplary embodiment.

FIG. 19 is a block diagram of a multimedia device including a decoding module, according to an exemplary embodiment.

The multimedia device 1900 of FIG. 19 may include a communication unit 1910 and the decoding module 1930. In addition, according to the use of a restored audio signal obtained as a decoding result, the multimedia device 1900 of FIG. 19 may further include a storage unit 1950 for storing the restored audio signal. In addition, the multimedia device 1900 of FIG. 19 may further include a speaker 1970. That is, the storage unit 1950 and the speaker 1970 are optional. The multimedia device 1900 of FIG. 19 may further include an encoding module (not shown), e.g., an encoding module for performing a general encoding function or an encoding module according to an exemplary embodiment. The decoding module 1930 may be integrated with other components (not shown) included in the multimedia device 1900 and implemented by at least one processor, e.g., a central processing unit (CPU).

Referring to FIG. 19, the communication unit 1910 may receive at least one of an audio signal or an encoded bitstream provided from the outside or may transmit at least one of a restored audio signal obtained as a result of decoding of the decoding module 1930 or an audio bitstream obtained as a result of encoding. The communication unit 1910 may be implemented substantially and similarly to the communication unit 1810 of FIG. 18.

According to an exemplary embodiment, the decoding module 1930 may receive a bitstream provided through the communication unit 1910 and decode the bitstream, by using a decoding apparatus of FIG. 16 or 17. In addition, FD extension decoding may be performed by using a decoding apparatus of FIG. 8, and in detail, an excitation signal generation unit of FIGS. 9 to 11.

The storage unit 1950 may store the restored audio signal generated by the decoding module 1930. In addition, the storage unit 1950 may store various programs required to operate the multimedia device 1900.

The speaker 1970 may output the restored audio signal generated by the decoding module 1930 to the outside.

Figure 20:
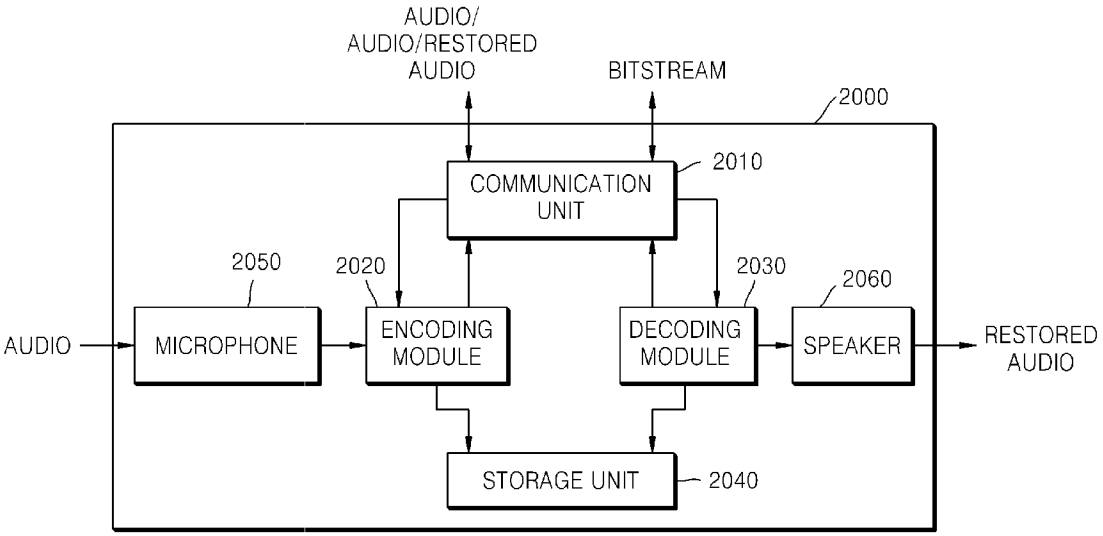
FIG. 20 is a block diagram of a multimedia device including an encoding module and a decoding module, according to an exemplary embodiment.

FIG. 20 is a block diagram of a multimedia device including an encoding module and a decoding module, according to an exemplary embodiment.

The multimedia device 2000 shown in FIG. 20 may include a communication unit 2010, an encoding module 2020, and a decoding module 2030. In addition, the multimedia device 2000 may further include a storage unit 2040 for storing an audio bitstream obtained as a result of encoding or a restored audio signal obtained as a result of decoding according to the usage of the audio bitstream or the restored audio signal. In addition, the multimedia device 2000 may further include a microphone 2050 and/or a speaker 2060. The encoding module 2020 and the decoding module 2030 may be implemented by at least one processor, e.g., a central processing unit (CPU) (not shown) by being integrated with other components (not shown) included in the multimedia device 2000 as one body.

Since the components of the multimedia device 2000 shown in FIG. 20 correspond to the components of the multimedia device 1800 shown in FIG. 18 or the components of the multimedia device 1900 shown in FIG. 19, a detailed description thereof is omitted.

Each of the multimedia devices 1800, 1900, and 2000 shown in FIGS. 18, 19, and 20 may include a voice communication only terminal, such as a telephone or a mobile phone, a broadcasting or music only device, such as a TV or an MP3 player, or a hybrid terminal device of a voice communication only terminal and a broadcasting or music only device but are not limited thereto. In addition, each of the multimedia devices 1800, 1900, and 2000 may be used as a client, a server, or a transducer displaced between a client and a server.

When the multimedia device 1800, 1900, or 2000 is, for example, a mobile phone, although not shown, the multimedia device 1800, 1900, or 2000 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 1800, 1900, or 2000 is, for example, a TV, although not shown, the multimedia device 1800, 1900, or 2000 may further include a user input unit, such as a keypad, a display unit for displaying received broadcasting information, and a processor for controlling all functions of the TV. In addition, the TV may further include at least one component for performing a function of the TV.

The methods according to the embodiments can be written as computer-executable programs and can be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While the exemplary embodiments have been particularly shown and described, it will be understood by those of ordinary skill in the art that various changes in form and details may be made therein without departing from the spirit and scope of the inventive concept as defined by the appended claims.

What is claimed is:

1. A method of generating an excitation class, the method including:

receiving audio from an input device;

first determining, based on a result of signal classification, whether a current frame of the audio corresponds to a speech signal;

when the current frame does not correspond to the speech signal, second determining, based on a tonal characteristic, whether the current frame corresponds to one of a noisy signal and a tonal signal; and generating, based on a result of the first determining and the second determining, an excitation class for the current frame, wherein the excitation class for the current frame is one of a plurality of excitation classes, wherein the plurality of excitation classes include a speech class, a tonal music class, and a non-tonal music class.

2. The method of claim 1, wherein the second determining is performed by comparing the tonal characteristic with a threshold.

3. The method of claim 1, wherein the generating the excitation class comprises generating, in response to the first determining, the speech class.

4. The method of claim 1, wherein the generating the excitation class comprises generating, in response to the second determining, the tonal music class and the non-tonal music class.

* * * * *